US006311467B1

(12) United States Patent
Osterloh

(10) Patent No.: US 6,311,467 B1
(45) Date of Patent: Nov. 6, 2001

(54) METHOD FOR PRODUCING A FILAMENT YARN WITH ALTERNATING S- AND Z-TWISTS

(75) Inventor: Markus Osterloh, Kempten (DE)

(73) Assignee: Saurer-Allma GmbH, Kempten (DE)

( * ) Notice: Subject to any disclaimer, the term of this patent is extended or adjusted under 35 U.S.C. 154(b) by 0 days.

(21) Appl. No.: 09/720,229

(22) PCT Filed: Jun. 4, 1999

(86) PCT No.: PCT/DE99/01692

§ 371 Date: Dec. 19, 2000

§ 102(e) Date: Dec. 19, 2000

(87) PCT Pub. No.: WO99/67452

PCT Pub. Date: Dec. 29, 1999

(30) Foreign Application Priority Data

Jun. 23, 1998 (DE) ..... 198 27 870

(51) Int. Cl.[7] ..... D02G 1/02; D02G 3/28
(52) U.S. Cl. ..... 57/293
(58) Field of Search ..... 57/293

(56) References Cited

U.S. PATENT DOCUMENTS 4,114,358 * 9/1978 Tscuhida et al. ..... 57/51
4,266,398 * 5/1981 Vogelsberg ..... 57/293
4,279,120 7/1981 Norris .
4,351,146 * 9/1982 Faure et al. ..... 57/293
5,752,496 * 5/1998 McPherson ..... 57/204

FOREIGN PATENT DOCUMENTS 14 35 728 1/1969 (DE) .
39 31 110 3/1990 (DE) .

* cited by examiner

*Primary Examiner*—Andy Falik
(74) *Attorney, Agent, or Firm*—Flynn, Theil, Boutell & Tanis, P.C.

(57) ABSTRACT

A method for producing a filament yarn with alternating S- and Z-twists. The yarn is moved between two twisting stops and submitted alternatively to S- and Z-twisting by at least one false twisting unit. The twists are fixed in a fixing unit situated downstream from the false twisting unit. The twisting stop downstream of the fixing unit is moved synchronously with the yarn and held in a yarn engagement position to stop the twisting until at least the twisting inversion points is fixed in the yarn. At least one other twisting stop oriented at a distance from the above mentioned moving twisting stop is engaged with the yarn in a way to stop the twisting and is moved along with the yarn before said yarn is submitted to an opposite twisting by the false twisting unit.

17 Claims, 6 Drawing Sheets

METHOD FOR PRODUCING A FILAMENT YARN WITH ALTERNATING S- AND Z-TWISTS

FIELD OF THE INVENTION

The invention relates to a method for producing a filament yarn with alternating S- and Z-twists, in which at least one yarn is moved between two spaced apart twisting stops arranged at a distance from each other, and the yarn receives thereby through at least one false twisting unit of the clamping type arranged between the twisting stops alternately S- and Z-twists which are fixed by means of a fixing unit which is interconnected downstream of the false twisting unit in yarn advancing direction.

BACKGROUND OF THE INVENTION

In such a method known from the DE 39 31 110 C2, the twisting stops are formed by two stationarily arranged delivery mechanisms, of which one is arranged upstream of the false twisting unit or units, and the other one downstream of the fixing unit, which is designed either as a heating device or as an air-circulating device. The alternating formation of the S- and Z-twists is carried out in a predetermined cycle by switching on and off the clamping action of the false twisting unit. Since, however, the second twisting stop is arranged downstream of the fixing unit in yarn advancing direction, the S- and Z-twists earlier applied to the yarn are, depending on the twisting direction, partially again untwisted and partially yet more tightly twisted in the yarn section extending downstream of the false twisting unit. Thus it is not possible in this manner to produce a yarn which has reproducible alternately defined S- and Z-twists. Furthermore nontwisted sections with a lesser S- or Z-twist are each created between the sections with S-twist and the sections with Z-twist.

SUMMARY OF THE INVENTION

The basic purpose of the invention is therefore to provide a method for producing a filament yarn with alternating S- and Z-twists, with which in a simple, economical and reproducible manner a filament yarn can be produced which has defined S- and Z-twists per unit of length and therebetween as much as possible no nontwisted or little twisted sections.

This is attained according to the invention by the twisting stop provided in yarn advancing direction downstream of the false twisting unit being moved synchronously with the yarn and being held in an engagement with the yarn stopping the twisting until at least the twisting inversion point in the yarn is fixed, and by at least one further twisting stop, following the aforementioned moved twisting stop at a distance, entering into an engagement with the yarn stopping the twisting, and advancing together with same before the yarn is twisted in an opposite direction by the false twisting unit.

Thus the invention is based on the thinking to grasp the yarn directly behind the false twisting unit by twisting stops successive in timely and spacial intervals, and to then advance the twisting stops synchronously together with the yarn. A twisting stop has the purpose to prevent a continuation of a twist applied to the yarn into a yarn section lying upstream of or downstream of the twisting stop. Clamping devices are primarily used as twisting stops in the present case, however, a twisting stop can also be designed as a guide edge or through clamping in a delivery mechanism. Yarn sections are in the inventive method each temporarily "fixed" between two spaced twisting stops which follow each other until the final fixation by means of the fixing unit takes place. The yarn sections extending fixed between two twisting stops have either a S- or Z-twist with a specific twist, whereby the term "twist" means according to DIN 60900, Part 2, the number of twists of a single yarn per/m. The specific twist of a section of yarn clamped between two adjacent twisting stops is not influenced or changed by the twists applied to the following yarn sections because the false wire is constructed always only up to the twisting stop closest to the false twisting unit. In this manner also nontwisted sections between the yarn sections with S- or Z-twist are avoided. The inventive method can be continuously carried out and enables the production of a filament yarn with alternating S- and Z-twists. The filament yarn can be produced out of a yarn component, namely a bunch of filaments, and is fixed during the production process following the false twisting unit, which is done by thermofixation.

BRIEF DESCRIPTION OF THE DRAWINGS

The invention will be discussed hereinafter in greater detail in connection with the exemplary embodiments illustrated in the drawing, in which.

DETAILED DESCRIPTION

Figure 1:
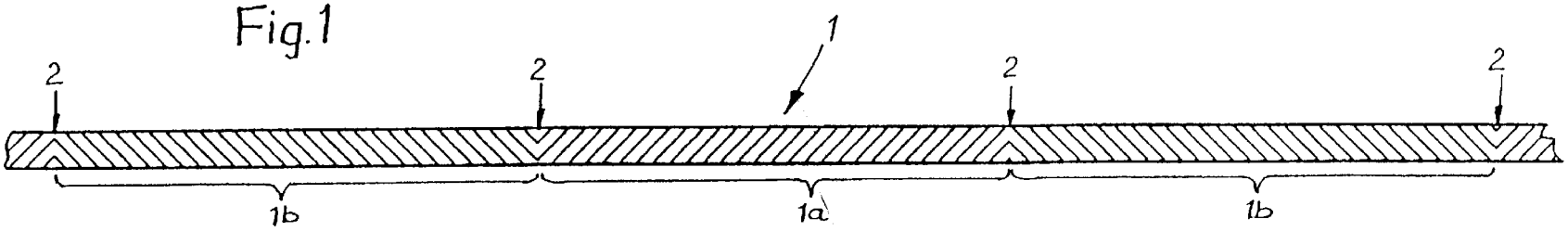
FIG. 1 schematically illustrates the structure of the finished filament yarn, FIG. 2 schematically illustrates the operating sequence for the method.
Figure 2:
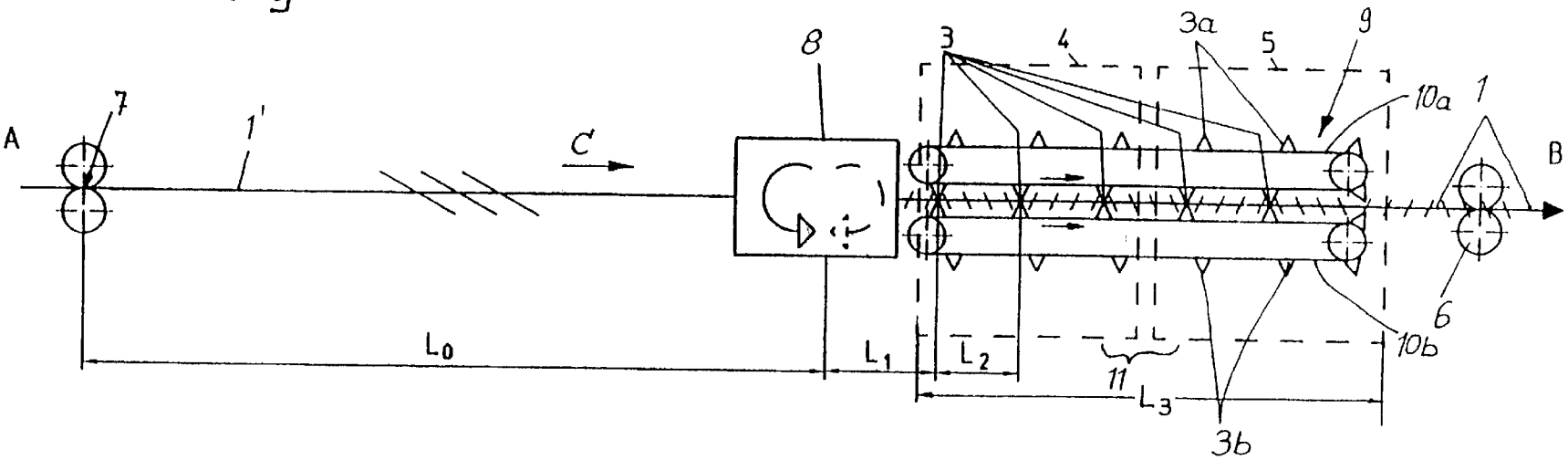

FIG. 1 schematically illustrates the structure of the finished filament yarn. Same has alternating yarn sections 1*a* with S-twists and yarn sections 1*b* with Z-twists. The twisting inversion points 2, the expansion of which in longitudinal direction of the yarn can be kept very small with the inventive method, each lie between two yarn sections 1*a*, 1*b* with opposite twists. The lengths of the yarn sections 1*a* , 1*b* can vary. Smooth and textured multi-filament yarns, preferably in a titer range of between 17 and 330 dtex, are supposed to be utilized as feed materials. FIG. 2 schematically illustrates the operating sequence for the method. The yarn 1' is moved from A to B in a yarn advancing direction C by means of the delivery mechanism 6, and leaves the delivery mechanism 6 as a finished filament yarn 1 with alternating S- and Z-twists, as it is illustrated in FIG. 1. A first twisting stop 7 is arranged stationarily and can advantageously be designed as a delivery mechanism or as a yarn tensioning device. A false twisting unit 8 is arranged at a distance $L_0$ downstream of the stationary twisting stop 7, with which false twisting unit it is possible to subject the yarn 1' successively to alternating S-twists and Z-twists. The detailed design of such false twisting units 8 will be discussed later on in connection with FIGS. 4*a* to 4*f*. A twisting stop device 9 with several twisting stops 3 movable in the yarn advancing direction C is provided behind the false twisting unit 8. Each twisting stop 3 is formed by two cooperating clamping jaws 3*a*, 3*b*, whereby these clamping jaws 3*a*, 3*b* are supposed to have an as small as possible expansion in the yarn advancing direction C, and are therefore advantageously designed like a blade. It is thus possible to reduce the length expansion of the twisting inversion point 2 to a minimum so that in the finished textile surface these inversion points 2 do not appear as areas of error. The clamping jaws 3*a,* 3*b* are arranged on continuously driven belts 10*a*, 10*b*, with which they each can be returned to the false twisting unit 8. Furthermore the clamping jaws 3*a*, 3*b* can in this manner be turned on and off. In the area lying between the belts 10*a* and 10*b*, opposing pairs of clamping jaws 3*a*, 3*b* are pressed against one another with the inter positioning of the yarn 1' to form then a twisting stop 3 movable in the yarn advancing direction C. The movable twisting stops 3 are spaced apart at a distance $L_2$. The twisting stops 3 are moved through a fixing unit 11, which consists of a heating zone 4 and a downstream oriented cooling zone 5. The spaced apart distance $L_2$ of the twisting stop 3 is thereby less than the length $L_3$ of the fixing unit 11. It is assured in this manner that the twists alternately oppositely applied to the yarn 1' and temporarily fixed between two twisting stops 3 are thermally fixed when the finished filament yarn 1 leaves the fixing unit 11.

In order for the method to operate as effectively as possible, the twisting stops 3 should engage the yarn 1' to stop the twisting as close as possible to the false twisting unit 8, and should then be advanced synchronously with the yarn 1'. With each new engagement of the yarn by a twisting stop it is possible to change the direction of the twist applications through the false twisting unit 8. Yarn sections 1*a* with S-twist and yarn sections 1*b* with Z-twist are alternately temporarily "fixed" between two twisting stop devices, and the yarn 1' is moved in a twisted state initially through the heating zone 4 and then through the cooling zone 5. Only after the yarn has been cooled off to below a specified temperature, the clamping is cancelled during an exit from the cooling zone 5. Because of the varying distance $L_0$ between the stationary twisting stop 7 and the false twisting unit 8 on the one hand and the distance $L_1$ between the false twisting unit 8 and the movable twisting stop 3 closest to it on the other hand, varying twist heights are created, namely twists per unit of length, in front of and after the false twisting unit 8. However, only the portion of the twists which lie between the false twisting unit 8 and the nearest moved twisting stop is fixed in the production process. The yarn is theoretically only tightly untwisted and tightly twisted in the area between the twisting stop 7 and the false twisting unit 8. The false twist is thus divided into two opposite true twists, of which in each case only the twist downstream of the false twisting unit is fixed. In order for this twist to no longer be influenced by the following reversal of the twisting direction, this twisting direction is supposed to be reversed only when the following twisting stop engages the yarn 1'. The respective next twisting stop is hereby supposed to be guided close to the false twisting unit 8 in order to keep the distance $L_1$ as small as possible. Namely, the yarn section in the area $L_1$ must during a reversal of the twisting direction be first again untwisted and twisted in the opposite direction. The shorter the distance at the start of the reversal of the twisting direction, the more effectively operates the method.

Figure 3:
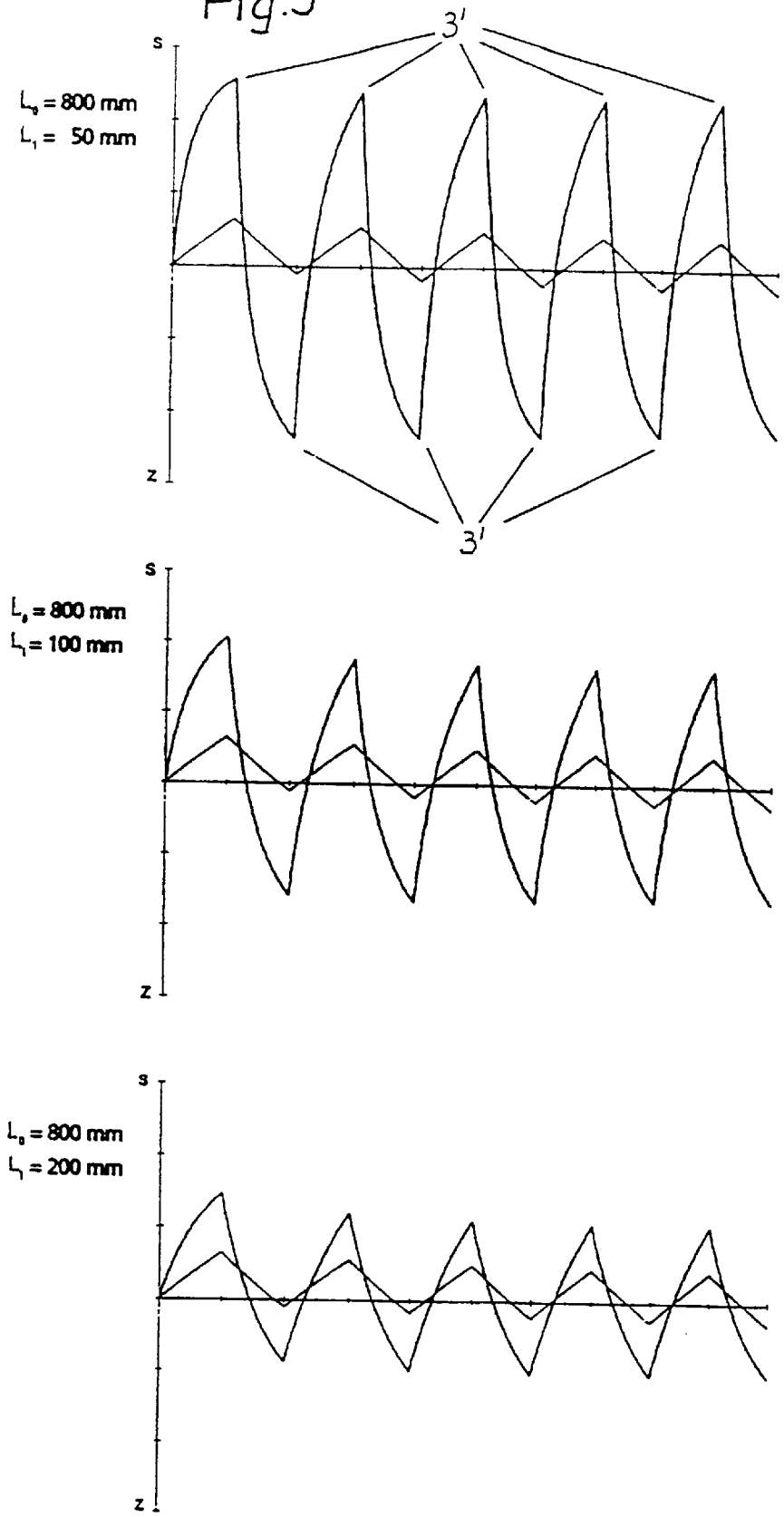
FIG. 3 illustrates the relationship between the minimal distance of the movable twisting stops from the false twisting unit under the theoretical twist distribution.

This can be recognized by looking at FIG. 3, which shows the theoretical influence of the distances $L_0$ and $L_1$ on the twist height upstream of and downstream of the false twisting unit 8. The times for the engagements of the movable twisting stops are indicated by the reference 3'. FIG. 3 illustrates that a large relationship of $L_0/L_1$ has a positive effect, and that the minimal distance $L_1$ between the respective twisting stop 3 which engage the yarn 1 and the twisting unit 8 should be as small as possible.

The changing twisting direction of the yarn can be realized both by one false twisting unit with changing twisting direction and also by two false twisting units which are constantly driven in opposite twisting directions, and which can be alternately interconnected. The use of two false twisting units, which are driven in different twisting directions and the active surfaces of which are interconnected, is advantageous. The masses, which are to be accelerated, are in this manner kept very small since the respective interconnection can occur through a movement of the yarn or through a deflection of the active areas.

Figure 4A:
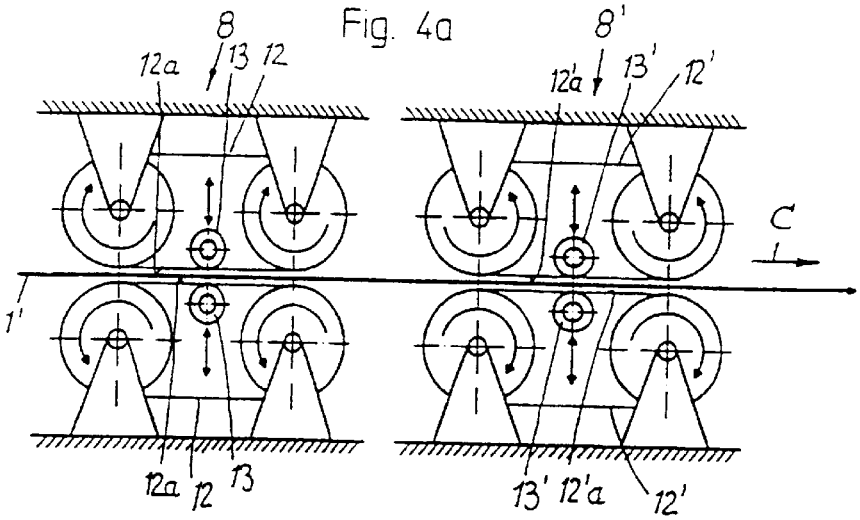
FIGS. 4*a* to 4*c* illustrate the operating principle of two series-connected false twisting units in a first embodiment.
Figure 4B:
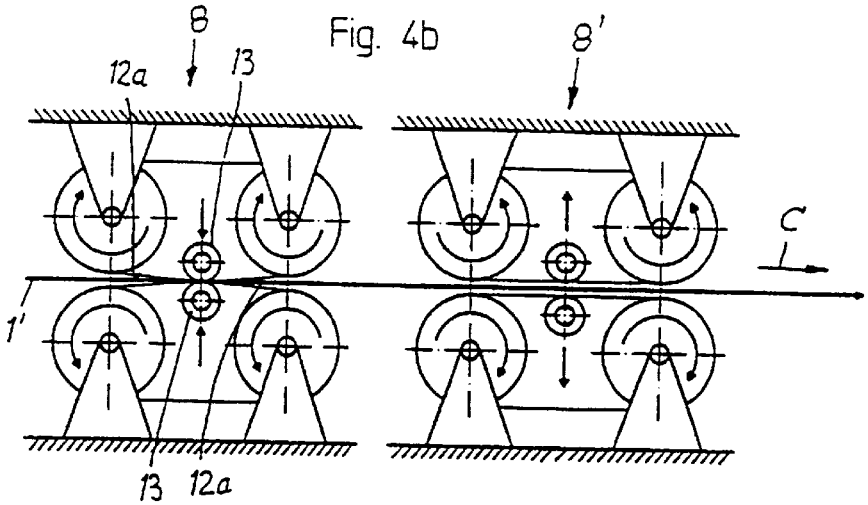
Figure 4C:
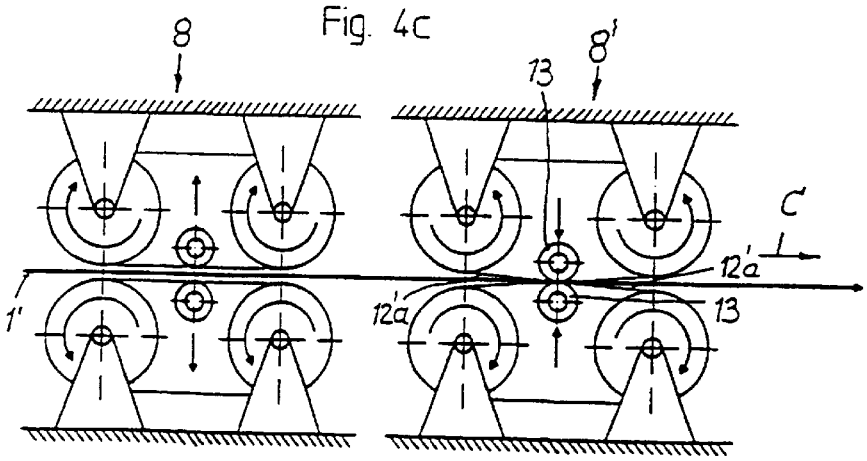

False twisting units 8, 8' or 8*a,* 8'*a* of the clamping type are illustrated in FIGS. 4*a* to 4*f*. In the exemplary embodiment illustrated in FIGS. 4*a* to 4*c,* each of the false twisting units 8, 8*a* has two crossing, continuous belts 12, 12', at the crossing point of which the yarn 1' can be clamped in order to create the twists. The belts 12 of the first false twisting unit 8 are, for example, driven in such a manner that they can give the yarn downstream, namely in yarn advancing direction downstream of the false twisting unit a S-twist, whereas the belts 12' of the second false twisting unit 8' can give the yarn downstream of the false twisting unit 8' a Z-twist. Each of the two false twisting units 8, 8' has furthermore two pressure rollers 13, 13', respectively, with the help of which the active areas 12*a,* 12'*a* of the belts 12, 12', respectively, which are usually spaced from the yarn 1', can be alternately moved into operating position, as this is illustrated in FIGS. 4*b* and 4*c*. The belts 12, 12' of the two respective false twisting units 8, 8' are continuously driven in the twisting directions indicated by arrows. When according to FIG. 4*b* the pressure rollers 13 press the active areas 12*a* against the yarn 1', the yarn receives S-twists downstream when the second false twisting unit 8' becomes inactive. In order to give the yarn Z-twists downstream, the pressure rollers 13 of the first false twisting unit 8 are according to FIG. 4*c* moved away from one another and the pressure rollers 13' of the second false twisting unit 8' press the active areas 12'*a* against the yarn 1'. By deflecting the active areas 12*a,* 12'*a* of the belts 12, 12' perpendicular to their direction of movement, very quick switching operations can be realized since, due to the geometry, only very small forces must be applied and only short paths of movement must be covered. The false twisting unit, which is not in the operating position, does not hinder the expansion of the twists in the yarn 1' since their active areas 12*a* or 12*a* ' are each spaced from the yarn 1'.

Figure 4D:
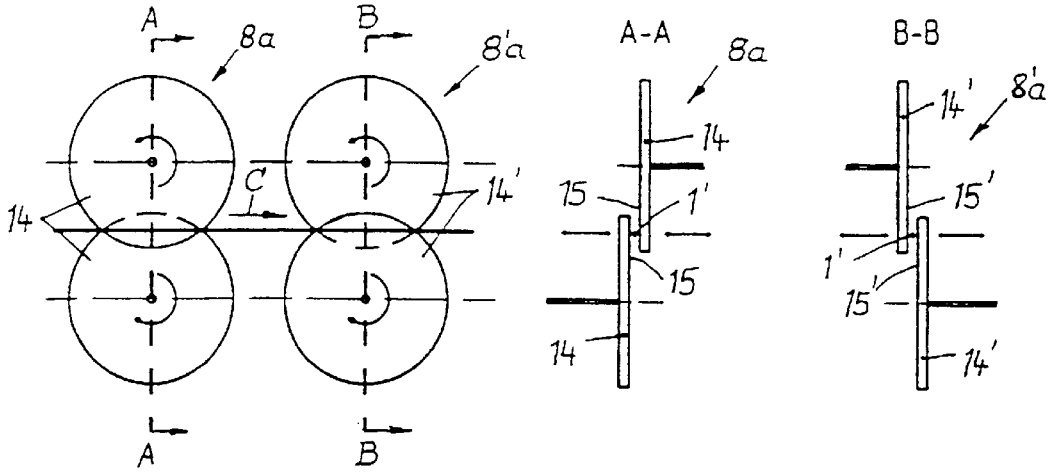
FIGS. 4*d* to 4*f* illustrate the operating principle of a second embodiment, FIGS. 5 to 7 schematically illustrate various movable twisting stop devices.
Figure 4E:
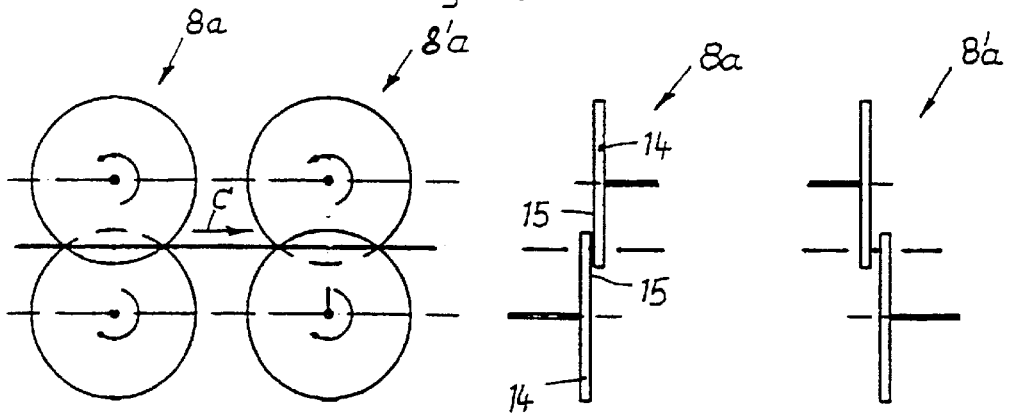
Figure 4F:
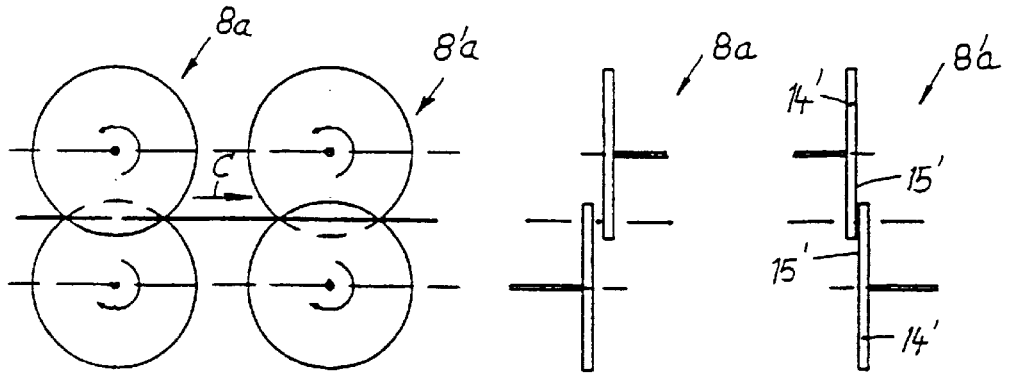

Each of the two false twisting units 8*a,* 8'*a* consist in the exemplary embodiment illustrated in FIGS. 4*d* to 4*f* of two continuously driven disks 14, 14', the axial faces of which form the active areas 15, 15', between which the yarn 1' can be clamped. This is accomplished by the two disks 14 or 14' axially approaching one another. Thus it is possible, for example according to FIG. 4*a,* to give the yarn 1' downstream, namely in yarn advancing direction C the yarn section extending downstream of the false twisting unit 8*a,* Z-twists when the active areas 15 of the disks 14 are pressed against the yarn 1' and the active areas 15' of the second false twisting unit 8*a* ' are spaced from the yarn 1' and are thus inactive. The active areas 15' are in the position of the false twisting units illustrated in FIG. 4*f* pressed against the yarn 1' and the yarn thus receives downstream S-twists and the first false twisting unit 8*a* is inactive.

Figure 5:
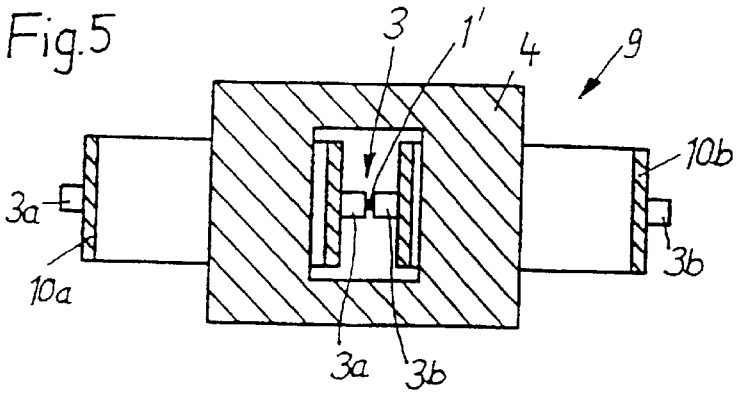
Figure 6:
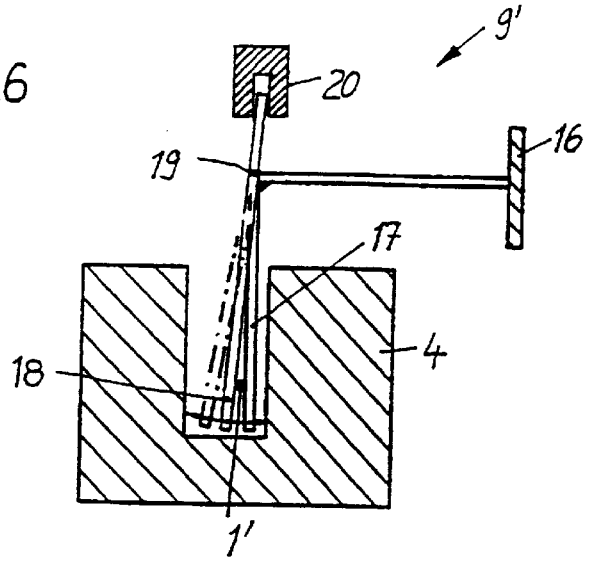
Figure 7:
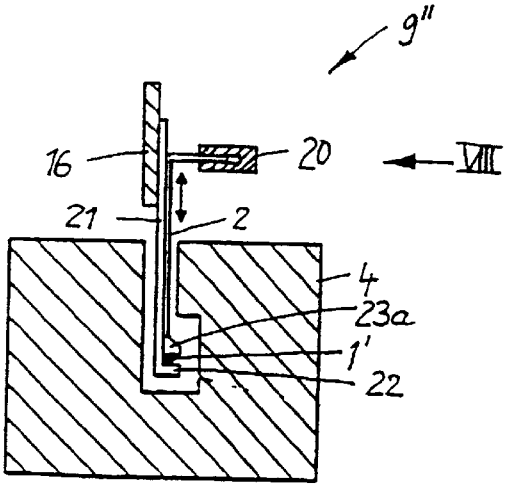

Various twisting stop devices are illustrated in FIGS. 5 to 7. The twisting stop device 9 illustrated in FIG. 5 corresponds essentially to the exemplary embodiment illustrated in FIG. 2 so that an explanation reference can be made to the description of FIG. 2. The evenly driven continuous driving means 10*a*, 10*b*, can, for example, be belts or chains.

Several rigid clamping elements 17 are, in the twisting stop device 9' illustrated in FIG. 6, arranged spaced from one another on the continuous driving means 16. A movable clamping element 18, which is pivotal about an axis 19, is associated with each rigid clamping element 17. When the movable clamping element 18 is pressed against the rigid clamping element 17, clamping occurs. A control cam 20 can be used to control the movable clamping element 18. The heating zone is identified by the referenced numeral 4.

Several support arms 21 are provided, in the twisting stop device 9" illustrated in FIG. 7, spaced from one another on a continuous driving means 16, which support arms each carry one rigid clamping jaw 22 on their free end. Each support arm 21 is associated with a movable slide member 23 having a clamping jaw 23*a*. The slide members 23 can be moved relative to the support arms 21 in their longitudinal direction by operation of a control cam 20 or the like, and the movable clamping jaws 23*a* can thus each be moved into a clamping position or an opening position. Each clamping jaw pair 22, 23*a* forms one twisting stop.

Figure 8:
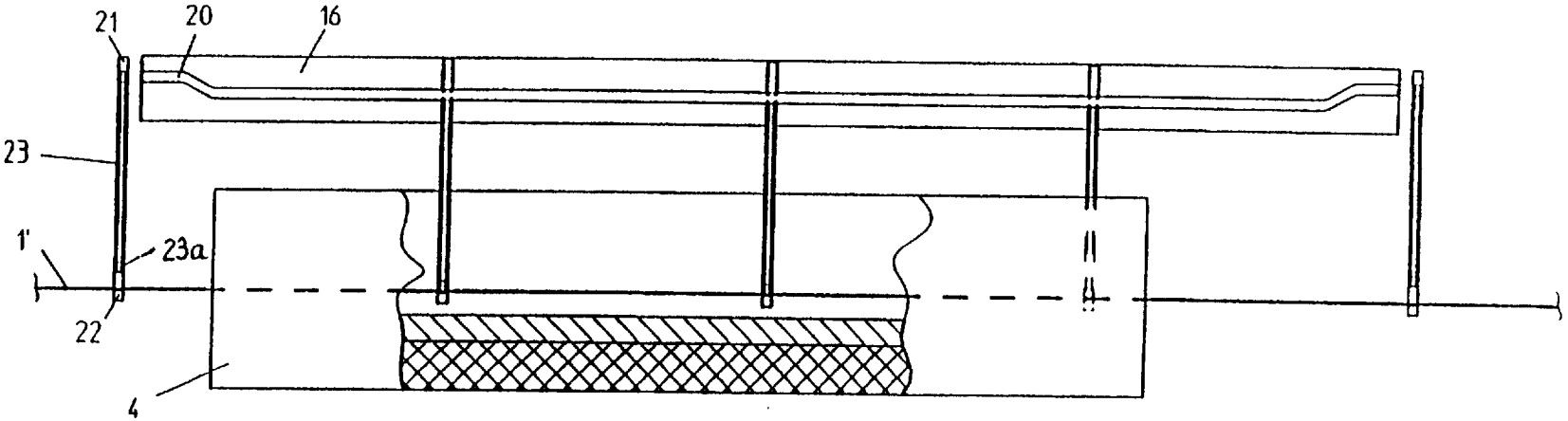
FIG. 8 is a view in direction VIII of FIG. 7.

In the exemplary embodiment illustrated in FIGS. 7 and 8, the clamping jaws 22 are arranged on relatively thin support arms 21 and at a greater distance from the driving means 16. When the clamping jaws 22, 23*a* are in a clamping position and thus in an engagement to stop twisting, they can elastically yield in yarn-advancing direction C and can thus compensate for changes in the length of the yarn, which changes can be created by twisting and shrinkage.

When the fixing unit 11 consists of a heating zone 4 and a cooling zone 5 connected thereafter, each yarn section 1*a* , 1*b* including the inversion points 2 lying therebetween is fixed. If necessary, it is, however, also possible to fix only the inversion points 2, which can, for example, be accomplished by heated clamping jaws.

What is claimed is:

1. In a method for producing a filament yarn with alternating S- and Z-twists comprising the steps of: clamping at least one yarn at two spaced apart twisting stops, applying through at least one false twisting unit stationarily arranged between the twisting stops alternately S- and Z-twists, and fixing the twists by means of a thermo-fixing unit positioned downstream of the false twisting unit in yarn advancing direction, wherein the improvement comprises the steps of bringing the first of said two twisting stops arranged downstream of the false twisting unit in clamping engagement with the yarn, thereby stopping the twisting at the clamped location;

advancing synchronously said first twisting stop and the yarn clamped thereto through the fixing unit, until at least the twisting inversion point in the yarn is fixed;

bringing at least one further twisting stop following the aforementioned first twisting stop into clamping engagement with the yarn, thereby stopping the twisting at the clamped location; and advancing said further twisting stop and the yarn clamped thereto through the fixing unit, before the yarn is twisted in an opposite direction by the false twisting unit.

2. The method according to claim 1, wherein a length of the fixing unit has a series oriented heating zone and a cooling zone, and orienting the spacing between the moved twisting stops to a spacing which is smaller than the length of the fixing unit.

3. The method according to claim 1, wherein the clamping of the yarn by the first twisting stop is released as soon as the yarn in the cooling zone falls below a certain temperature.

4. The method according to claim 1, wherein the first and further twisting stops are moved linearly.

5. The method according to claim 4, wherein the location whereat clamping is occurring by the first and further twisting stops is controlled to be as small as possible of a dimension in the yarn advancing direction.

6. The method according to claim 5, wherein said small as possible dimension is controlled by providing bladelike clamping jaws.

7. The method according to claim 1, wherein said clamping occurs in each instance by moving a pair of jaws toward one another.

8. The method according to claim 1, wherein the movable twisting stops are cyclically returned to an initial position adjacent the false twisting unit.

9. The method according to claim 8, wherein each respective first and further twisting stop is first guided close to the false twisting unit prior to entering into the clamping engagement with the yarn.

10. The method according to claim 1, wherein the in-between distance between two of the moving twisting stops, which are in clamping engagement with the yarn to stop twisting, is elastically flexible in yarn advancing direction.

11. The method according to claim 1, including a controlling of the distance between the twisting stop stationarily arranged upstream of the false twisting unit and the false twisting unit to be at any time greater than the distance between the false twisting unit and the movable twisting stop which is the closest to said false twisting unit.

12. The method according to claim 1, wherein the movable twisting stops are moved with the yarn through the thermal fixing unit having a series oriented heating zone and a cooling zone interconnected thereafter.

13. The method according to claim 1, wherein the moving twisting stops are heated in order to fix the twistings of the yarn.

14. The method according to claim 1, wherein the false twisting unit includes two constantly driven false twisting units of which one is suited to give the yarn downstream S-twists and the other is suited to give the yarn Z-twists, and wherein the false twisting units are moved alternately into an operating yarn engaging position.

15. The method according to claim 1, including a controlling of the time of the twist applications in the respective direction so as to correspond with the length of the yarn section with one twisting direction.

16. The method according to claim 1, wherein the distance between two twisting stops is stochastically changed.

17. The method according to claim 1, including an urging of opposing pairs of the movable twisting stops force-lockingly together to effect the clamping of the yarn therebetween.

* * * * *